US005608912A

United States Patent [19]

Cumberland

[11] Patent Number: 5,608,912

[45] Date of Patent: Mar. 11, 1997

[54] ATHLETIC SUPPORT GLOVE AND STRAP

[76] Inventor: Keith Cumberland, 3625 Lyles Dr., Oxford, Miss. 38655

[21] Appl. No.: 630,446

[22] Filed: Apr. 10, 1996

[51] Int. Cl.[6] ..... A41D 13/10; A41D 19/00

[52] U.S. Cl. ..... 2/16; 2/161.1; 2/162

[58] Field of Search ..... 2/159, 160, 161.1, 2/161.5, 161.6, 163, 16, 162, 161.4; 602/62, 64

[56] References Cited

U.S. PATENT DOCUMENTS

| | | | |
|---|---|---|---|
| D. 363,153 | 10/1995 | Brasseur | 2/161.1 |
| 3,707,730 | 1/1973 | Slider | 2/161.1 |
| 4,295,229 | 10/1981 | Clark et al. | 2/161.1 |
| 4,411,024 | 10/1983 | Hayes | 2/161 |
| 4,632,105 | 12/1986 | Barlow | 602/64 |
| 4,815,147 | 3/1989 | Gazzano et al. | 2/161 |
| 5,004,227 | 4/1991 | Hoffman | 2/159 |
| 5,517,694 | 5/1996 | Fabry | 2/162 |

FOREIGN PATENT DOCUMENTS

| | | | |
|---|---|---|---|
| 2456289 | 6/1976 | Germany | 2/2 |

*Primary Examiner*—C. D. Crowder
*Assistant Examiner*—Larry D. Worrell, Jr.

[57] ABSTRACT

My invention comprises an athletic support glove that will allow its user to engage in vigorous athletic activity while protecting the fingers, thumb and hand from lacerations, abrasions, bruises, dislocations and fractures that injure many athletes. The athletic support glove is provided with non-elastic partitions between each of the adjacent fingers as well as between the index finger and thumb, and a strap that secures the thumb to the hand and wrist of the wearer.

1 Claim, 4 Drawing Sheets

ATHLETIC SUPPORT GLOVE AND STRAP

BACKGROUND OF THE INVENTION

This invention is in the field of athletic equipment designed to support parts of the human hand to protect it against injury due to the stress experienced during strenuous athletic activity. U.S. Pat. No. 4,632,105 discloses an elastic hand and wrist wrap which lacks the security of a glove. U.S. Pat. No. 5,517,694 discloses a weightlifting glove that includes a partially elastic and partially inelastic strap for supporting the hand and wrist of the wearer, but provides no support or protection for the thumb of the wearer.

SUMMARY

I have invented an athletic support glove that will allow its user to engage in vigorous athletic activity while protecting the fingers, thumb and hand from lacerations, abrasions, bruises, dislocations and fractures that injure many athletes. The athletic support glove is provided with non-elastic partitions between each of the adjacent fingers as well as between the index finger and thumb, and a strap that secures the thumb to the hand and wrist of the wearer.

DETAILED DESCRIPTION

Athletic gloves that include partitions between the fingers of the glove are known in the art. However, most such gloves are designed to aid a swimmer to capture more water with his hands during each swimming stroke, propelling the swimmer forward with greater efficiency. Such gloves are usually made of rubber, which is elastic, and are not designed to protect the swimmer from injury to his fingers or thumb of his hands.

Athletic activity has always been prone to injury. All too often such injuries shorten the careers of promising athletes. In sports which require the use of more force by the hands of the player, such as football as it is played in the United States, the players often suffer injury to their fingers or thumbs. In the sport of football, the hands of the athletes who participate in that sport receive severe impact, pressure, twists and pulls that the hand of the athlete is unable to absorb without injury.

In the past, gloves have been provided for those athletes that play football to aid their hands in absorbing those abnormal forces. Since the gloves that have been provided have not eliminated such injuries, trainers have resorted to taping two fingers together in a technique known as "buddy taping" to use the strength of one finger to help support another adjacent finger which has been weakened by a prior injury. However, the design of prior athletic gloves together with techniques such as "buddy taping" have not eliminated injuries to the hands of athletes.

I have designed an athletic glove that combines the protection afforded by prior athletic gloves with non-elastic support for the fingers and thumb of the wearer. As shown in the accompanying Figures, my athletic glove 1 may be fabricated from any suitable material such as sturdy cloth, leather or nylon, and includes partitions 2 affixed between each two adjacent fingers of the glove, and a partition 3 affixed between the index finger and the thumb of the glove. Partitions 2 and 3 may be made of any material that is non-elastic, such as sturdy cloth, leather or nylon. Partitions 2 and 3 may be woven or made of webbing material, not shown, if desired. Partitions 2 may be affixed to the fingers of glove 1 by stitching 2', and partition 3 may be affixed to the index finger and thumb of glove 1 by stitching 3'.

Figure 1:
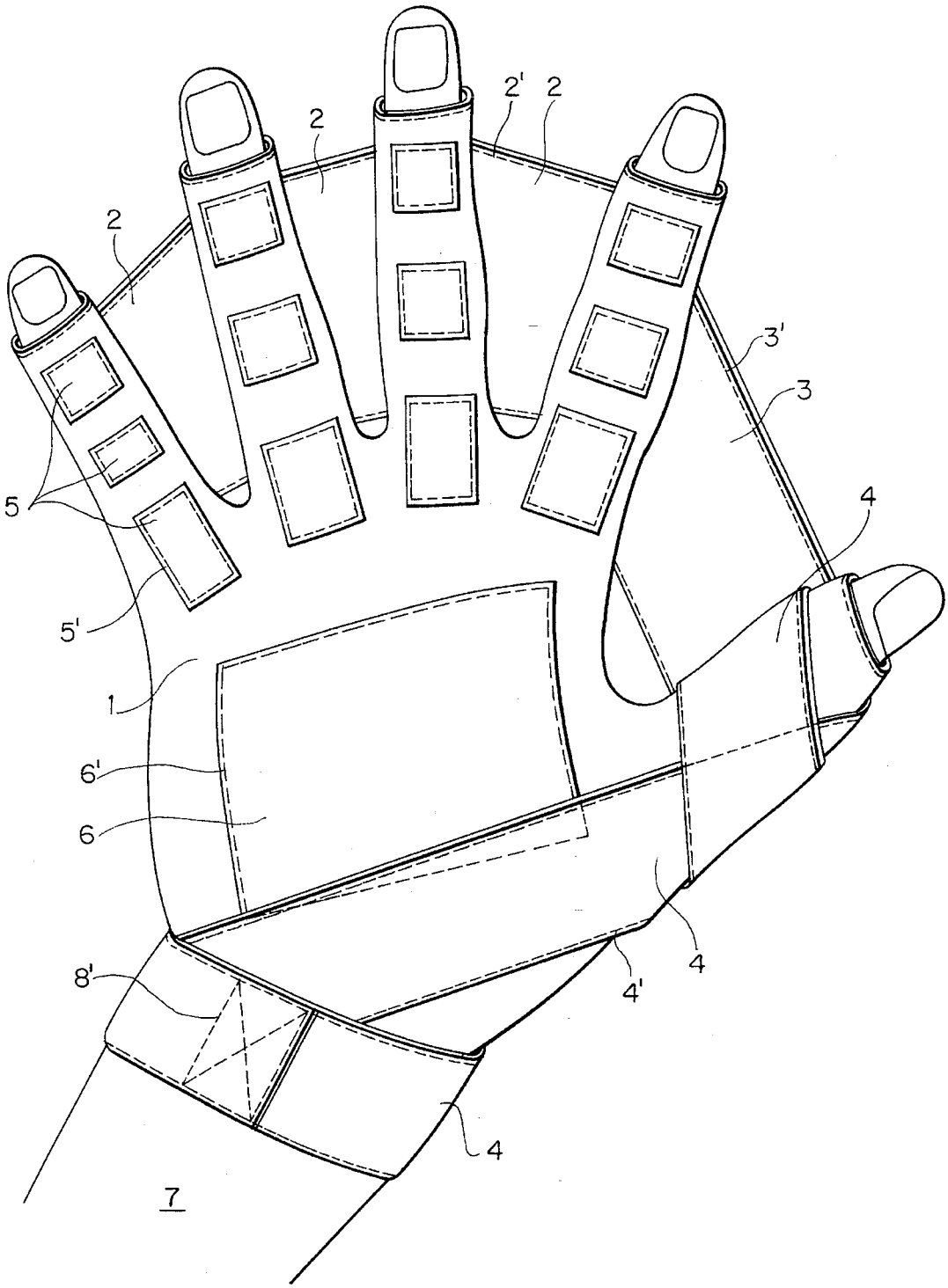
FIG. 1 is a two-dimensional view of my athletic support glove on the hand of a wearer of that glove shown from the back of the hand of the wearer.
Figure 2:
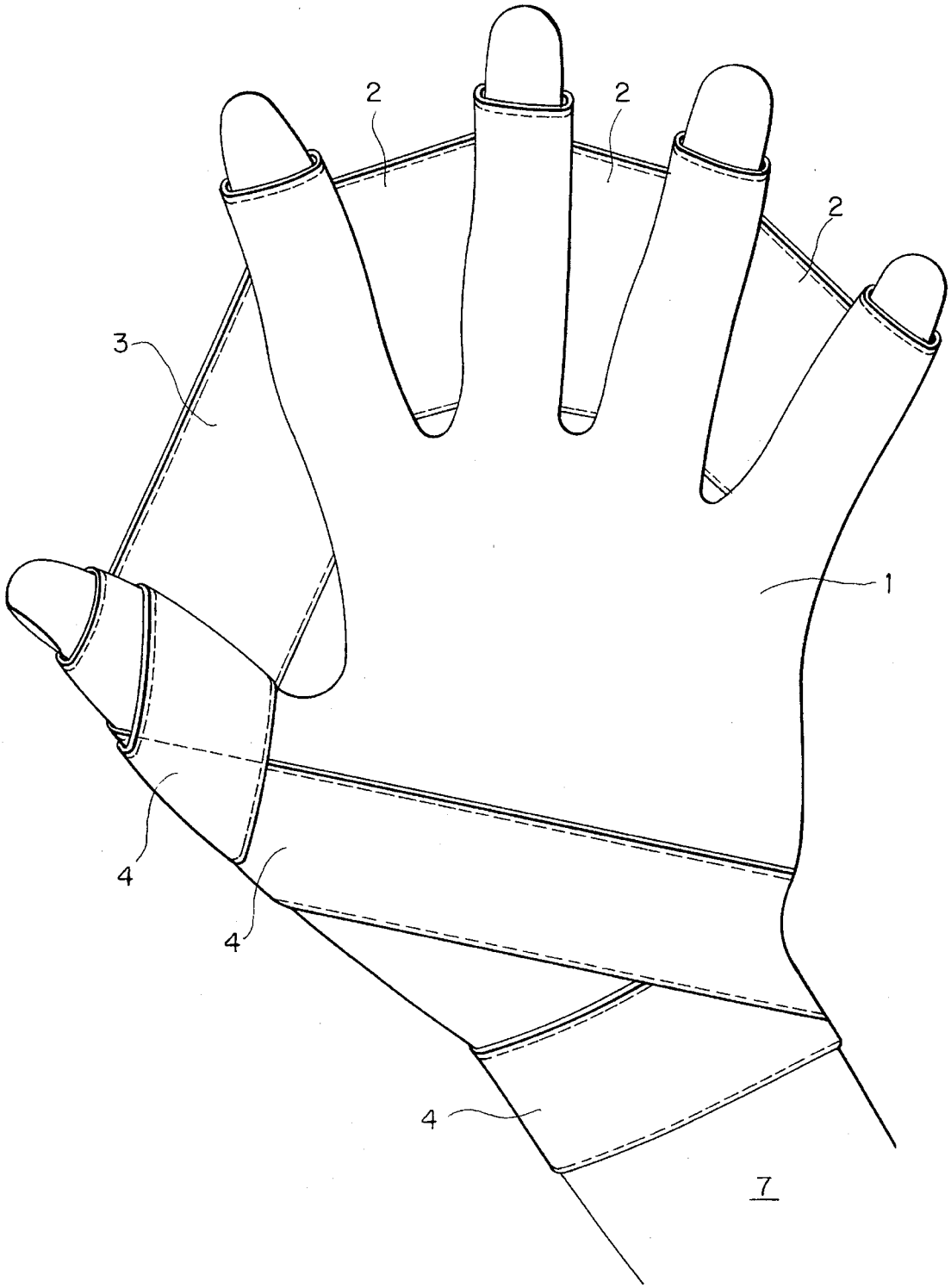
FIG. 2 is a two-dimensional view of my athletic support glove on the hand of a wearer of that glove shown from the palm of the hand of the wearer.
Figure 3:
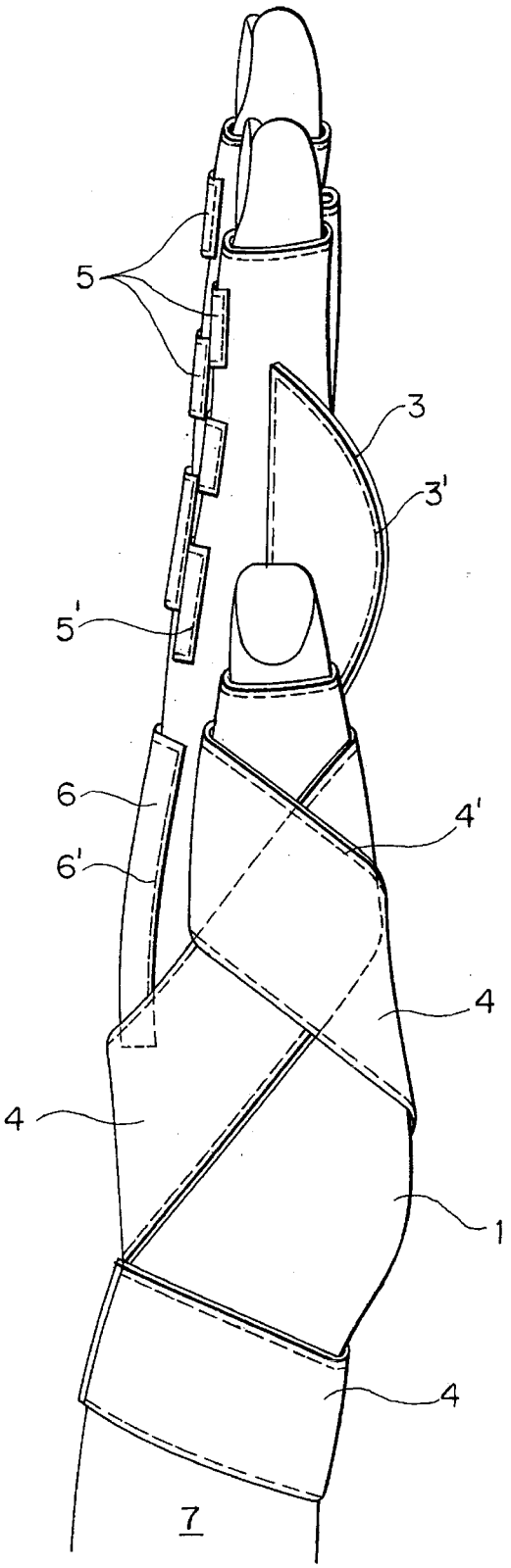
FIG. 3 is a two-dimensional view of my athletic support glove on the hand of a wearer of that glove shown from the side of that hand that includes the wearer's thumb.
Figure 4:
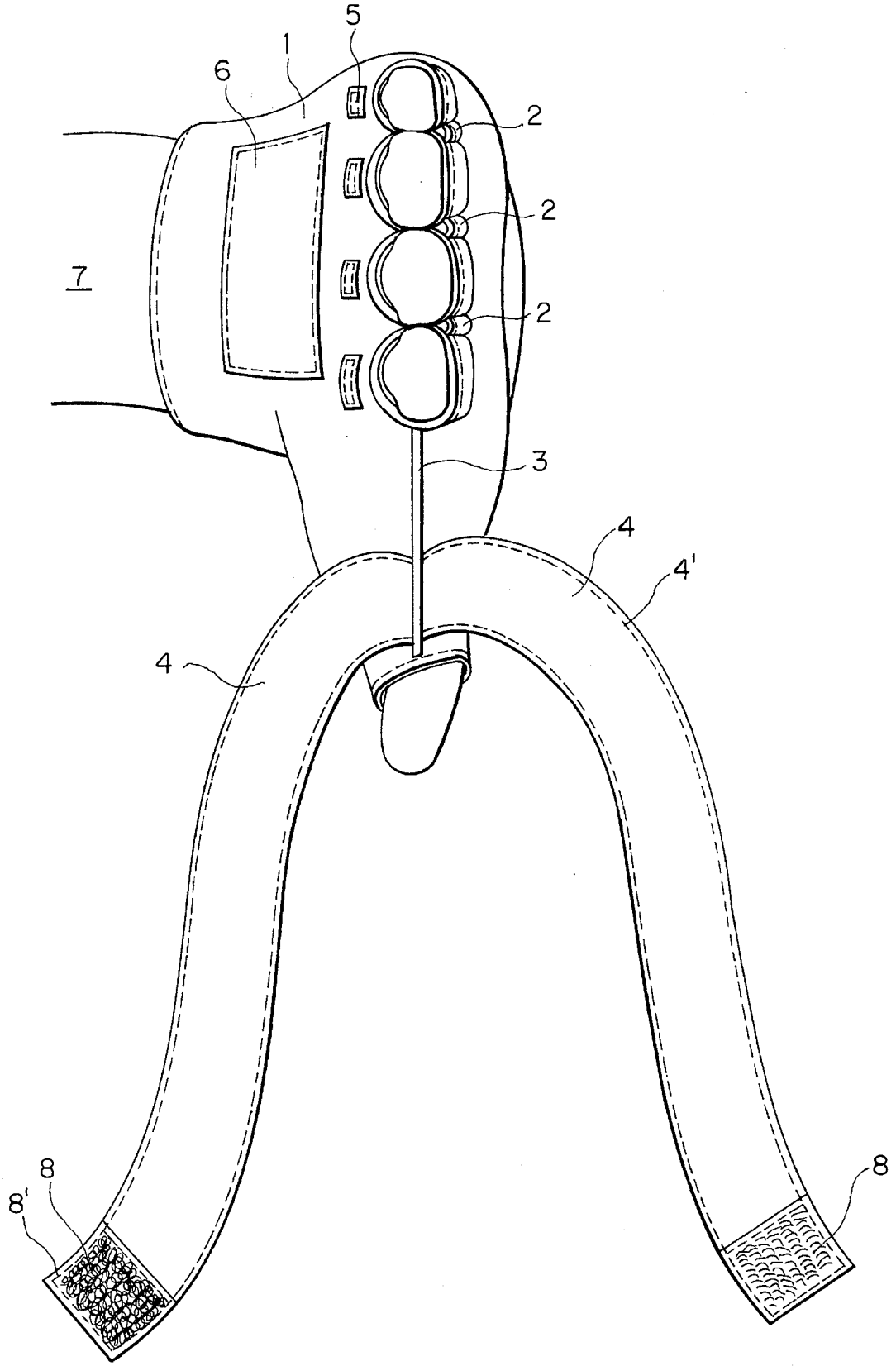
FIG. 4 is a two-dimensional view of my athletic support glove on the hand of a wearer of that glove shown from the end of that outstretched hand when all four fingers of that hand have been drawn together in alignment with that hand.

In addition, my athletic glove includes a strap 4 that is affixed to glove 1 at some suitable location inside the thumb of glove 1 as shown in FIG. 4. Strap 4 may be fabricated from any suitable material such as sturdy cloth, leather or nylon, and may be affixed to the thumb of glove 1 by stitching 4'. Strap 4 should be made long enough to be wrapped first around the thumb of glove 1, as shown in FIGS. 1, 2 and 3, and thence to be wrapped around the portion of the glove that covers the hand of the wearer of glove 1, as shown in FIGS. 1, 2, and 3, and thence to be wrapped around the glove at the wrist 7 of the hand of the wearer as shown in FIGS. 1, 2 and 3, and finally to be fastened around the glove at the wrist 7 of the wearer as shown in FIGS. 1, 2 and 3. Any suitable means may be provided to fasten strap 4 around wrist 7, but a velcro 8 closure is preferable. The two faces of VELCRO® 8 closure material may be affixed to strap 4 in any suitable manner, such as stitching 8', as shown in FIGS. 1 and 4.

Glove 1 also may be provided with padded cushions 5 and 6 to protect the back of the hand of the wearer of glove 1 from impact or abrasion. FIGS. 1, 3 and 4 show padded cushions 5 affixed to glove 1 in positions substantially adjacent to and over the knuckles of the fingers of a hand of the wearer of glove 1. Padded cushions 5 may be affixed to glove 1 in any suitable manner, such as by stitching 5', as shown in FIGS. 1 and 3. FIGS. 1, 3 and 4 show padded cushion 6 affixed to glove 1 in a position substantially adjacent to and over the back of a hand of the wearer of glove 1. Padded cushion 6 may be affixed to glove 1 in any suitable manner, such as by stitching 6', as shown in FIGS. 1 and 3.

I have sought to describe the best form of my invention to those who read this patent. However, my athletic support glove can be manufactured and used in several forms, and I intend to protect the spirit of my invention in all of its various forms.

I claim:

1. An athletic support glove comprising a hand, a wrist, four fingers and a thumb that includes substantially non-elastic partitions affixed between each of the two adjacent fingers of that glove and a substantially non-elastic partition affixed between the index finger and thumb of that glove, and a two-tipped strap provided with fastening means affixed to each of said two tips, said strap affixed to the thumb of that glove in a manner that allows said strap to be wrapped around the thumb of that glove, thence around the hand of that glove, and thence around the wrist of that glove and fastened by said fastening means affixed to each of the two tips of that strap.

* * * * *